US007559819B2

(12) United States Patent
Tokioka et al.

(10) Patent No.: US 7,559,819 B2
(45) Date of Patent: Jul. 14, 2009

(54) IMAGE DISPLAY APPARATUS AND PRODUCTION METHOD THEREOF

(75) Inventors: Masaki Tokioka, Kanagawa (JP); Hiroharu Ueda, Kanagawa (JP); Mitsutoshi Hasegawa, Kanagawa (JP); Tokutaka Miura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 11/414,307

(22) Filed: May 1, 2006

(65) Prior Publication Data

US 2006/0194501 A1 Aug. 31, 2006

Related U.S. Application Data

(62) Division of application No. 10/229,081, filed on Aug. 28, 2002, now Pat. No. 7,119,482.

(30) Foreign Application Priority Data

Aug. 31, 2001 (JP) ..... 2001-262719

(51) Int. Cl.
*H01J 9/00* (2006.01)

(52) U.S. Cl. ..... 445/25; 445/40; 445/44; 445/57

(58) Field of Classification Search ..... None
See application file for complete search history.

(56) References Cited

U.S. PATENT DOCUMENTS

| | | | | |
|---|---|---|---|---|
| 4,395,244 | A | 7/1983 | Glaser | 445/25 |
| 5,594,296 | A | 1/1997 | Mitsutake et al. | 313/495 |
| 5,697,825 | A | 12/1997 | Dynka et al. | 445/25 |
| 5,807,154 | A | 9/1998 | Watkins | 445/25 |
| 5,827,102 | A | 10/1998 | Watkins et al. | 445/25 |
| 6,036,567 | A | 3/2000 | Watkins | 9/26 |
| 6,060,113 | A | 5/2000 | Banno et al. | 427/78 |
| 6,210,245 | B1 | 4/2001 | Sando et al. | 445/6 |
| 6,220,912 | B1 | 4/2001 | Shigeoka et al. | 445/24 |
| 6,309,691 | B1 | 10/2001 | Hasegawa | 427/8 |
| 6,313,579 | B1 * | 11/2001 | Nakano et al. | 313/493 |
| 6,634,916 | B2 * | 10/2003 | Kaneko et al. | 445/25 |
| 2002/0180342 | A1 | 12/2002 | Yamada et al. | 313/493 |

FOREIGN PATENT DOCUMENTS

| | | |
|---|---|---|
| EP | 1258906 | 11/2002 |
| JP | 64-41952 | 2/1989 |
| JP | 2-16505 | 5/1990 |
| JP | 2000-211951 | 8/2000 |
| JP | 2001-338578 | 12/2001 |
| KR | 1998-702352 | 7/1998 |
| KR | 2001-0090524 | 10/2001 |
| WO | WO 97/23893 | 7/1997 |
| WO | WO 01/54161 A1 | 7/2001 |

* cited by examiner

*Primary Examiner*—Ashok Patel
(74) *Attorney, Agent, or Firm*—Fitzpatrick, Cella, Harper & Scinto

(57) ABSTRACT

A joining material like an In film having a low melting point forms a surface oxide film when melted. If the oxide film is thick, an uneven surface shape will remain as it is, and can cause vacuum leakage during vacuum sealing. This problem is solved, for example, by placing particles of a refractory material inside the low melting joining material. The particles of the refractory material serve as a holding member for the low melting material and break the oxide film during a joining operation to bring the seal bonding with the low melting material to perfection.

3 Claims, 14 Drawing Sheets

IMAGE DISPLAY APPARATUS AND PRODUCTION METHOD THEREOF

This application is a division of U.S. application Ser. No. 10/229,081, filed Aug. 28, 2002.

BACKGROUND OF THE INVENTION

1. Field of the Invention

The present invention relates to image display apparatus using an electron source substrate with electron-emitting devices therein and, more particularly, to structure in a vacuum seal bonding portion.

2. Related Background Art

There are two types of conventionally known electron-emitting devices, thermal electron sources and cold cathode electron sources. The cold cathode electron sources include field emission devices (FE devices), metal/insulator/metal devices (MIM devices), surface conduction electron-emitting devices, and so on.

A surface conduction electron-emitting device will be outlined below in brief.

The foregoing surface conduction electron-emitting device, as schematically illustrated in FIGS. 17A, 17B, is comprised of a pair of device electrodes 2, 3 facing each other on a substrate 1, and an electroconductive film 4 coupled to the device electrodes and having an electron-emitting region in part thereof.

Since the above-stated surface conduction electron-emitting device is simple in structure and easy in production, it has the advantage of capability of forming an array of many devices over a large area. A variety of applications to take advantage of the feature are thus under research. For example, such applications include an electron source substrate in which a number of surface conduction electron-emitting devices are wired in a matrix pattern or the like, flat-panel image forming apparatus such as display apparatus using the electron source substrate, and so on.

FIG. 18 is a schematic illustration of a display panel constructed using the electron source substrate with a number of such electron-emitting devices therein. FIG. 18 shows the schematic sectional structure of the peripheral region of the display panel (envelope 90).

In FIG. 18, numeral 21 designates the electron source substrate with a number of electron-emitting devices (not shown) therein, which is also called a rear plate. Numeral 82 denotes a face plate in which a fluorescent film, a metal back, etc. are formed on an internal surface of a glass substrate. Numeral 86 represents a support frame.

The envelope 90 is constructed by bonding and sealing the rear plate 21, the support frame 86, and the face plate 82. The seal bonding procedure of the envelope 90 will be briefly described below.

First, the rear plate 21 and the support frame 86 are preliminarily joined to each other with frit glass 202.

Then In films 203 as a panel joining material are soldered to the support frame 86 and to the face plate 82. At this time, in order to enhance the bond strength of the In films 203 to the support frame 86 and to the face plate 82, it is desirable to provide silver paste films 204 as underlying layers.

Thereafter, the support frame 86 and the face plate 82 are joined to each other through the In films 203 at a temperature over the melting point of In in a vacuum chamber, so as to effect seal bonding, thereby forming the envelope 90.

The above-stated conventional seal bonding method of image forming apparatus, however, had the problems described below.

The joining material is In, which is a material having the relatively low melting point of 156° C. and emitting a relatively small amount of emission gas at the softening point=melting point. In use of In, there arises a problem that surface oxide films are formed in the In films 203 on the occasion of implementing ultrasonic soldering of the In films 203 to the support frame 86 and to the face plate 82, or to the silver paste films 204 as underlying layers.

Namely, the oxide films have a high melting temperature of 800° C. or more, and thus remain as oxide films even after pure In has melted during the seal bonding operation. As long as the oxide films are thin, they can break or chemically react with pure In to lose the shape of the oxide films, thus posing no problem. However, if the oxide films are thick, the uneven surface shape will remain as it is, and can give rise to vacuum leakage.

In is easy to oxidize in the atmosphere and oxygen quickly diffuses into the interior thereof at temperatures over the melting point to form a thick oxide film. Therefore, the conventional seal bonding method had the problem that the vacuum leakage was likely to occur at thick portions of the oxide films formed during the ultrasonic soldering process.

These problems can also be similarly serious problems in the case of the metals other than In or alloy materials being used as the joining material.

SUMMARY OF THE INVENTION

An object of the present invention is to provide image display apparatus with little vacuum leakage, with high reliability, and with high display quality.

An aspect of the present invention is an image display apparatus comprising an envelope having a first substrate, and a second substrate opposed with a gap to the first substrate; and image display means placed in the envelope, wherein in a peripheral region of the first substrate or the second substrate, the first substrate and the second substrate are seal-bonded with a joining member of a metal having inside thereof a member of material which has a melting point higher than that of the joining member metal.

Another aspect of the present invention is an image display apparatus comprising an envelope having a first substrate, and a second substrate opposed with a gap to the first substrate; and image display means placed in the envelope, wherein in a peripheral region of the first substrate or the second substrate, the first substrate and the second substrate are seal-bonded with a joining member of a metal held by a holding member.

Still another aspect of the present invention is an image display apparatus comprising an envelope in which a first substrate with an electron-emitting device therein and a second substrate with an image display member are seal-bonded through a joining member with a predetermined gap between, wherein a holding member for holding the joining member is provided inside the joining member and the holding member has a melting point higher than a softening temperature of the joining member and has high wettability to the joining member.

Another aspect of the present invention is a method of producing an image display apparatus comprising an envelope having a first substrate, and a second substrate opposed with a gap to the first substrate; and image display means placed in the envelope, the method comprising a step of seal-bonding the first substrate and the second substrate with a joining member of a metal having inside thereof a member of material which has a melting point higher than that of the joining member metal, in a peripheral region of the first substrate or the second substate.

Another aspect of the present invention is a method of producing an image display apparatus comprising an envelope having a first substrate, and a second substrate opposed with-a gap to the first substrate; and image display means placed in the envelope, the method comprising a step of seal-bonding the first substrate and the second substrate with a joining member of a metal held by a holding member, in a peripheral region of the first substrate or the second substrate.

DETAILED DESCRIPTION OF THE PREFERRED EMBODIMENTS

Figure 1:
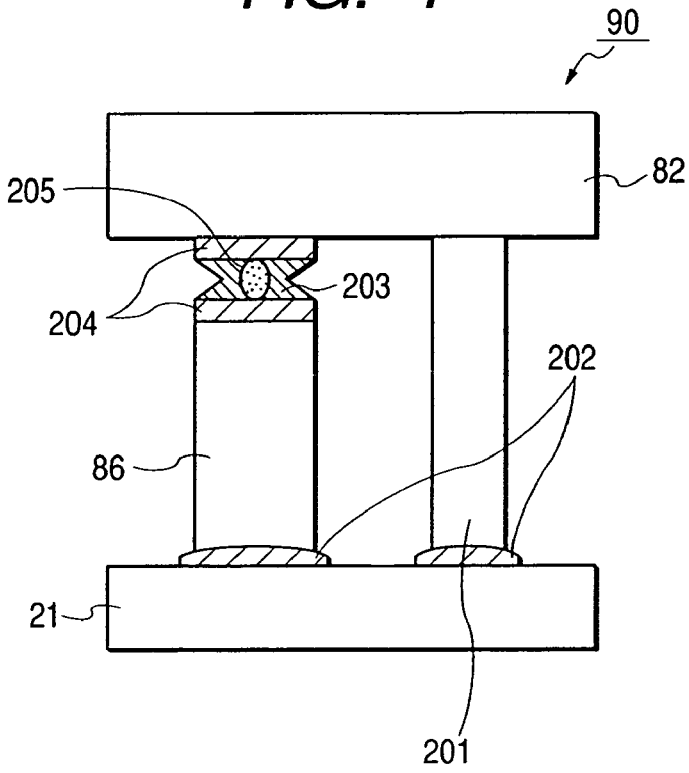
FIG. 1 is an illustration showing a schematic sectional structure of the peripheral region of the display panel (envelope) according to Example 1 of the present invention.

Configurations according to the present invention are as follows.

Specifically, a first aspect of the present invention is an image display apparatus comprising an envelope having a first substrate, and a second substrate opposed with a gap to the first substrate; and image display means placed in the envelope, wherein in a peripheral region of the first substrate or the second substrate, the first substrate and the second substrate are seal-bonded with a joining member of a low melting metal having a member of a refractory material inside thereof.

According to the first aspect of the present invention as described, the joining member has the member of the refractory material having the melting point higher than that of the joining member, inside thereof, whereby during the seal bonding operation, the member of the refractory material can break the surface oxide film of the joining member so as to exclude the oxide film successfully from the joint surface. Therefore, adhesion (bond strength) is high between the joint surfaces of the substrates and the joining member and the envelope is obtained with excellent seal performance. Furthermore, the member of the refractory material ensures excellent holding performance for the gap between the two substrates.

The first aspect of the present invention includes each of the following features as a more favorable form:

the member of the refractory material is a metal;

the member of the refractory material has a thickness equal to a thickness of the joining member in a direction of the gap;

the member of the refractory material is a member obtained by coating a surface of a base material with an oxidation-resistant metal;

the member of the refractory material is a hydrogen storing metal;

the image display means comprises an electron-emitting device and a phosphor.

A second aspect of the present invention is an image display apparatus comprising an envelope having a first substrate, and a second substrate opposed with a gap to the first substrate; and image display means placed in the envelope, wherein in a peripheral region of the first substrate or the second substrate, the first substrate and the second substrate are seal-bonded with a joining member of a metal held by a holding member.

According to the second aspect of the present invention, the joining member of the metal is held by the holding member, so that the joining member of the metal undergoes little sag or flow with heat. Therefore, adhesion (bond strength) is high between the joint surfaces of the substrates and the joining member and the envelope is obtained with excellent seal performance. This good holding of the joining member of the metal can be substantiated by properly selecting a material with high wettability to the joining member, as a material for the holding member.

The second aspect of the present invention includes each of the following features as a more favorable form:

the holding member is a metal;

the holding member has a thickness equal to a thickness of the joining member in a direction of the gap;

the holding member is a member obtained by coating a surface of a base material with an oxidation-resistant metal;

the holding member is a hydrogen storing metal;

the image display means comprises an electron-emitting device and a phosphor.

A third aspect of the present invention is an image display apparatus comprising an envelope in which a first substrate with an electron-emitting device therein and a second substrate with an image display member are seal-bonded through a joining member with a predetermined gap between, wherein a holding member for holding the joining member is provided inside the joining member and the holding member has a melting point higher than a softening temperature of the joining member and has high wettability to the joining member.

The third aspect of the present invention includes each of the following features as a more favorable form:

the holding member has a thickness equal to a thickness of the joining member in a direction of the gap;

the holding member is a member obtained by coating a surface of a base material with an oxidation-resistant metal;

the holding member is a hydrogen storing material;

the holding member is provided with a function of positioning itself;

the electron-emitting device is a lateral field emission electron-emitting device;

the first substrate is a substrate with a plurality of electron-emitting devices therein;

the plurality of electron-emitting devices are matrix-wired;

the image display member comprises a fluorescent film consisting of phosphors and a black conductive material;

the image display member comprises a metal back covering the fluorescent film.

In the image display apparatus according to the third aspect of the present invention, the joining-member-holding member having the melting point higher than the softening temperature of the joining member is provided inside the joining member for joining the electron source substrate and the opposite substrate to each other, whereby during the joining work in a molten state of the joining member, the joining-member-holding member can break the surface oxide film of the joining member, so as to exclude the oxide film from the joint surface. This prevents the uneven surface shape of the oxide film from remaining in the joint surface as it is, particularly, even in the case of the oxide film being thick. This suppresses occurrence of vacuum leakage. Since the joining-member-holding member has high wettability to the joining member, it is feasible to prevent the molten joining member from being repelled by the holding member to flow out during the joining work between the electron source substrate and the opposite substrate, whereby the joining member is secured in sufficient thickness, so as to be able to suppress the occurrence of vacuum leakage extremely effectively.

A fourth aspect of the present invention is a method of producing an image display apparatus comprising an envelope having a first substrate, and a second substrate opposed with a gap to the first substrate; and image display means placed in the envelope, the method comprising a step of seal-bonding the first substrate and the second substrate with a joining member of a low melting metal having a member of a refractory material inside thereof, in a peripheral region of the first substrate or the second substrate.

The fourth aspect of the present invention includes each of the following features as a more favorable form;

the member of the refractory material is a metal;

the image display means comprises an electron-emitting device and a phosphor.

According to the fourth aspect of the present invention, the joining member has the member of the refractory material having the higher melting point than that of the joining member, inside thereof, so that during the seal bonding process the member of the refractory material can break the surface oxide film of the joining member, so as to exclude the oxide film from the joint surface. Therefore, high adhesion (bond strength) can be yielded between the joint surfaces of the substrates and the joining member.

A fifth aspect of the present invention is a method of producing an image display apparatus comprising an envelope having a first substrate, and a second substrate opposed with a gap to the first substrate; and image display means placed in the envelope, the method comprising a step of seal-bonding the first substrate and the second substrate with a joining member of a metal held by a holding member, in a peripheral region of the first substrate or the second substrate.

According to the fifth aspect of the present invention, the joining member of the metal is held by the holding member, so that during the seal bonding process the joining member of the metal experiences little flow. Therefore, it is feasible to secure the sufficient thickness of the joining member and thus yield good seal performance of the envelope.

The fifth aspect of the present invention includes each of the following features as a more favorable form:

the holding member is a metal;

the image display means comprises an electron-emitting device and a phosphor.

The "metal" stated above is a notion also including alloys.

The preferred embodiments of the present invention will be illustratively described below in detail with reference to the drawings. It is, however, noted that the dimensions, materials, and shapes of the components, the relative arrangement thereof, etc. described in the embodiments are by no means intended to limit the scope of the present invention only to those.

Figure 17A:
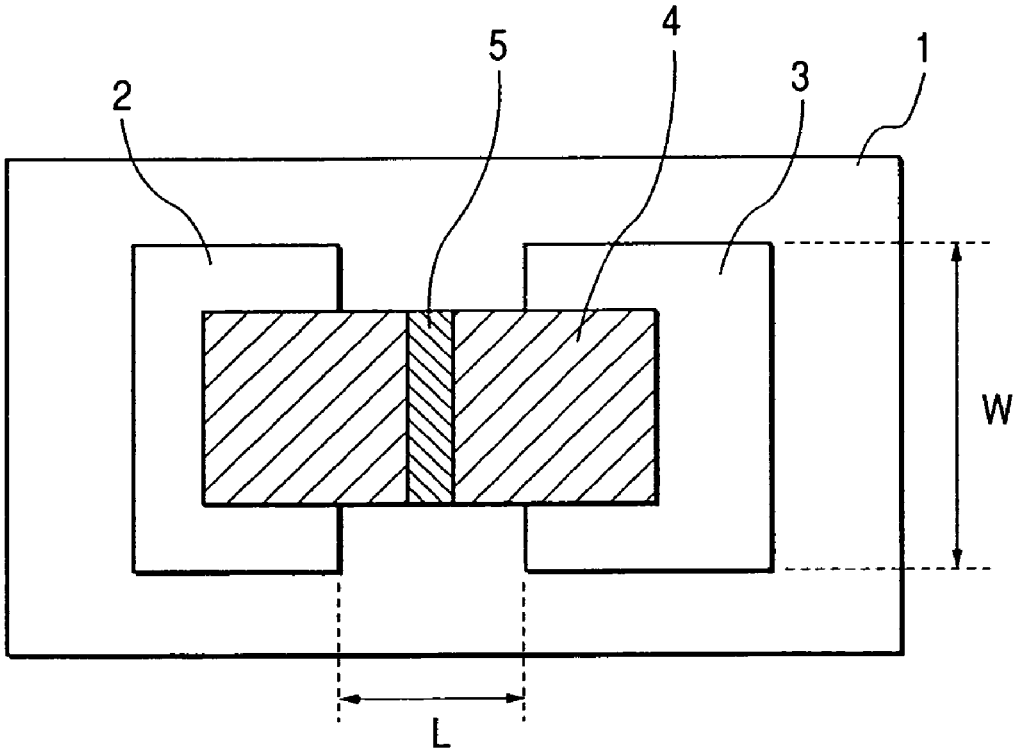
FIG. 17A RELATED ART
FIGS. 17A and 17B are schematic illustrations showing a configuration example of the surface conduction electron-emitting device.
Figure 17B:
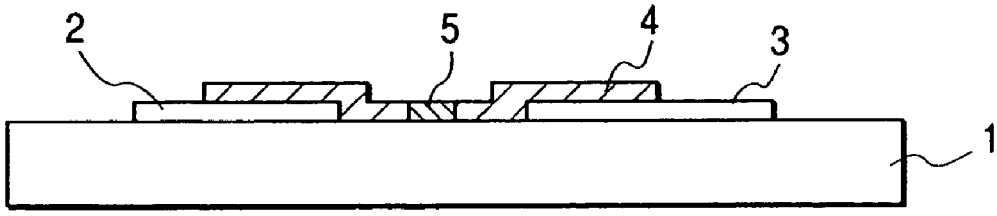
FIG. 17B RELATED ART
Figure 18:
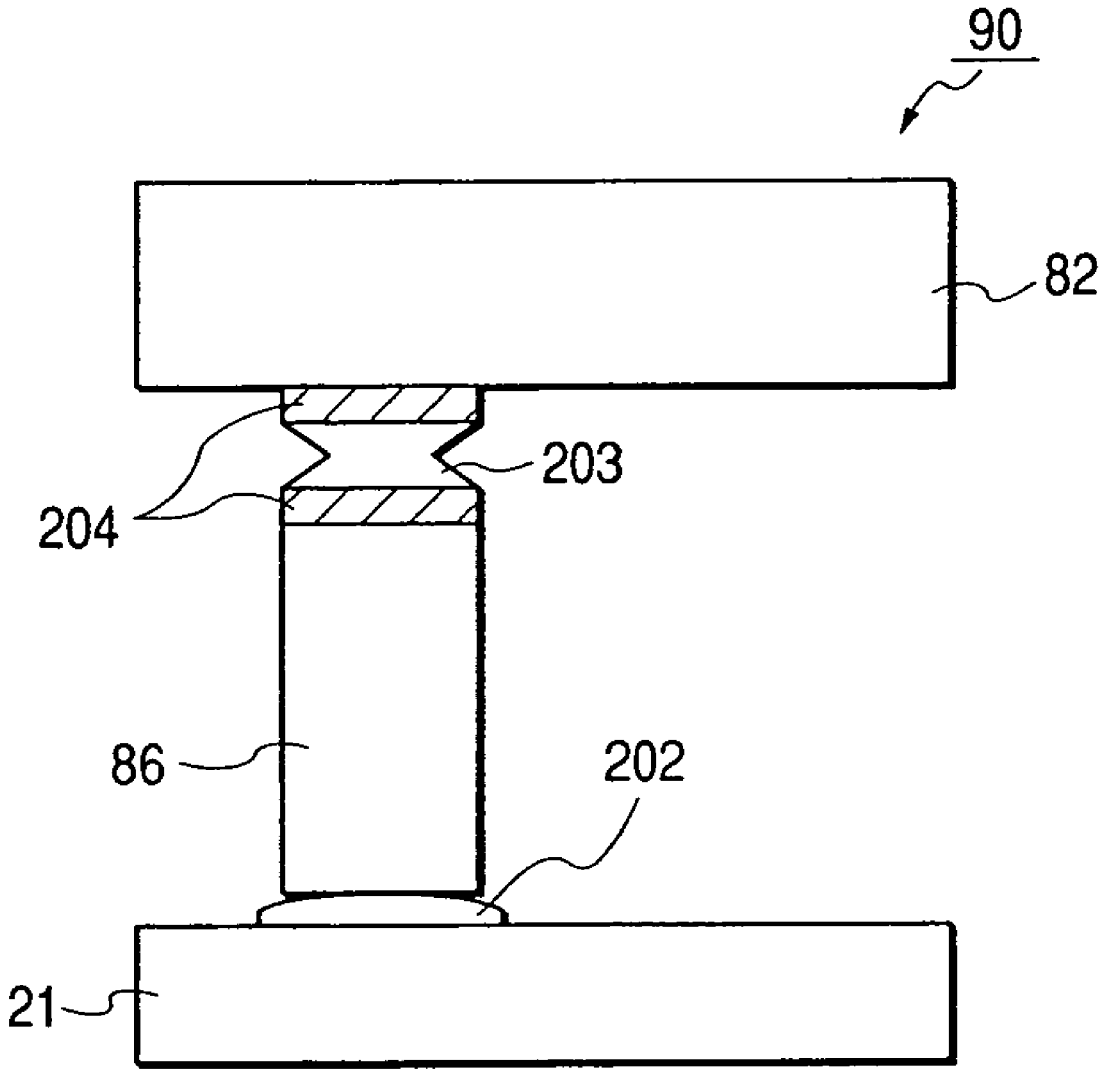
FIG. 18 RELATED ART
FIG. 18 is an illustration showing a schematic sectional structure of the peripheral region of the conventional display panel (envelope).

The electron-emitting devices placed in the electron source substrate of the present embodiment can be of the configuration illustrated in FIGS. 17A, 17B.

The substrate 1 is made of glass or the like, and the size and thickness thereof are properly determined depending upon the number of electron-emitting devices placed thereon, upon the design shape of the individual devices, and upon mechanical conditions and others such as atmospheric-pressure-resistant structure for maintaining a vessel in vacuum where the substrate forms part of the vessel during use of the electron source.

Inexpensive soda lime glass is normally used as the glass material, but it is necessary in this case to use a sodium blocking layer thereon; for example, a substrate on which a silicon oxide film is formed in the thickness of about 0.5 μm by sputtering. Besides it, the substrate can also be made of a glass containing a small amount of sodium, or a silica substrate.

A material for the device electrodes 2, 3 is selected from ordinary conductor materials; for example, the material is preferably selected from metals such as Ni, Cr, Au, Mo, Pt, Ti, and so on, and metals such as Pd—Ag and others, or the material is properly selected from printed conductors consisting of a metal oxide and glass or the like, transparent conductors such as ITO and others, and so on. The thickness of the device electrodes 2, 3 is preferably determined in the range of several hundred Å to several μm.

Furthermore, the device electrodes can also be formed by applying a commercially available paste containing metal particles of platinum Pt or the like by printing such as offset printing or the like.

For the purpose of obtaining a finer pattern, the device electrodes can also be formed by a process of applying a photosensitive paste containing platinum Pt or the like by printing such as screen printing or the like, effecting exposure of the paste with a photomask, and developing the paste.

The device electrode spacing L, the device electrode length W, the shape of the device electrodes 2, 3, etc. are properly designed according to an application form of the actual devices or the like, but the spacing L is preferably in the range of several thousand Å to 1 mm and more preferably in the range of 1 μm to 100 μm in consideration of the voltage placed between the device electrodes or the like. The device electrode length W is preferably in the range of several μm to several hundred μm in consideration of the resistance of the electrodes, and the electron emission characteristics.

The electroconductive film (device film) 4 to serve as an electron source is formed so as to connect the device electrodes 2, 3.

The electroconductive film 4 is particularly preferably a microparticle film comprised of microparticles, in order to yield good electron emission characteristics. The thickness of the electroconductive film 4 is properly determined in consideration of the step coverage over the device electrodes 2, 3, the resistance between the device electrodes, forming operation conditions described hereinafter, and so on, and the thickness is preferably in the range of several Å to several thousand Å and particularly preferably in the range of 10 Å to 500 Å. The sheet resistance of the electroconductive film 4 is preferably in the range of 103 to 107 Ω/□.

The microparticle film stated herein is a film consisting of an ensemble of microparticles and the fine structure thereof can not be only a state in which microparticles are individually dispersed, but can also be a film in a state in which microparticles are adjacent to each other or overlap with each other (including an island pattern). The particle size of the microparticles is in the range of several Å to several thousand Å and preferably in the range of 10 Å to 200 Å.

Palladium Pd is normally suitable for the material of the electroconductive film, but the material does not have to be limited to it. A film forming method of the electroconductive film can also be properly selected from sputtering, a method of applying a solution and baking it, and so on.

The electron-emitting region 5 can be formed, for example, by the energization operation as described below. For convenience' sake of illustration, the electron-emitting region 5 is illustrated in rectangular shape in the center of the electroconductive film 4, but it is noted that this is a schematic illustration and does not always loyally represent the actual position and shape of the electron-emitting region.

By supplying a power from an unrepresented power supply to between the device electrodes 2, 3 under a predetermined degree of vacuum, a gap (fissure) resulting from change of structure is formed in a part of the electroconductive film 4. This gap region constitutes the electron-emitting region 5. Emission of electrons occurs under a predetermined voltage from the vicinity of the gap formed by the above forming, but the electron emission efficiency is still very low in this state.

Figure 8A:
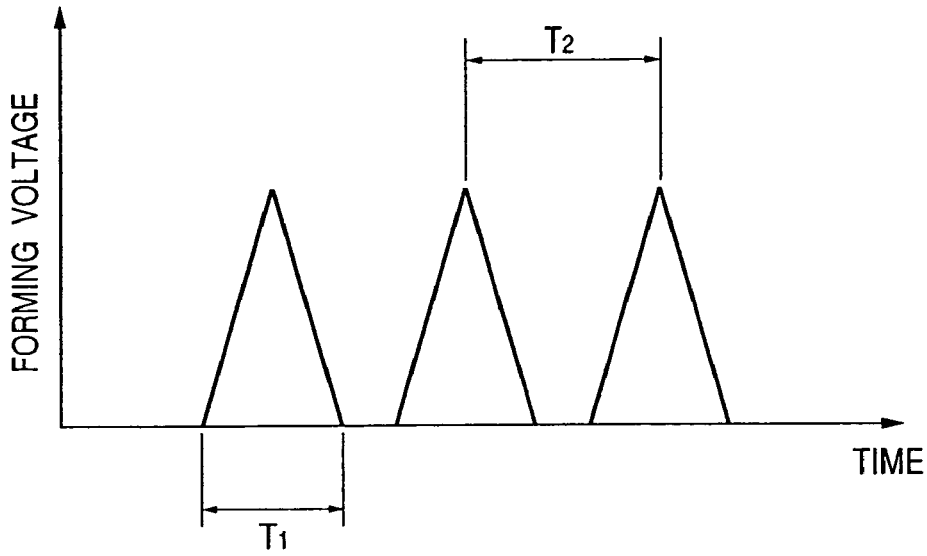
FIGS. 8A and 8B are graphs showing examples of forming voltage.
Figure 8B:
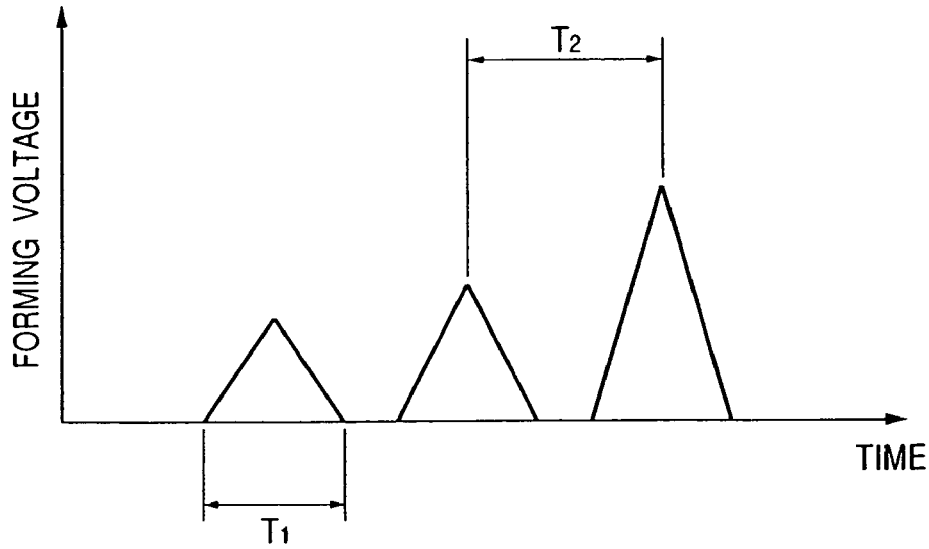

FIGS. 8A and 8B show examples of voltage waveforms in the energization forming operation. Particularly preferable voltage waveforms are pulse waveforms. There are two techniques for applying pulses: a technique of continuously applying pulses with pulse peak heights at a fixed voltage as shown in FIG. 8A, and a technique of applying pulses with increasing pulse peak heights as shown in FIG. 8B.

First, the technique of applying the pulses with pulse peak heights at the fixed voltage will be described referring to FIG. 8A. In FIG. 8A, T1 and T2 represent the pulse width and the pulse spacing of the voltage waveform. Normally, T1 is set in the range of 1 μsec to 10 msec, and T2 in the range of 10 μsec to 100 msec. The peak height of the triangular pulses (the peak voltage in energization forming) is properly selected according to the form of the electron-emitting device. Under such conditions, the voltage is applied, for example, for the period of several seconds to several ten minutes. The pulse waveform does not have to be limited to the triangular waves, but any desired waveform, e.g., rectangular waves or the like, can also be adopted.

The technique of applying the voltage pulses with increasing pulse peak heights will be described next referring to FIG. 8B. In FIG. 8B, T1 and T2 can be similar to those shown in FIG. 8A. The peak heights of triangular waves (peak voltages in energization forming) can be increased, for example, by steps of about 0.1 V.

The end of the energization forming operation can be determined as follows; an electric current flowing through the device during application of the pulse voltage is measured, a resistance is calculated based thereon, and the energization forming is ended, for example, when the resistance becomes not less than 1 MΩ.

The electron emission efficiency is still very low in the state after this forming operation. In order to increase the electron emission efficiency, it is desirable to perform an operation called activation for the device.

This activation operation can be performed by repeatedly applying the pulse voltage to between the device electrodes 2, 3 under an appropriate degree of vacuum with an organic compound present therein. Then a gas containing carbon atoms is introduced, and carbon or a carbon compound deriving therefrom is deposited as a carbon film in the vicinity of the aforementioned gap (fissure).

An example of this step will be described. For example, tolunitrile is used as a carbon source, it is introduced through a slow leak valve into a vacuum space, and the pressure is maintained at about $1.3\times10^{-4}$ Pa. The pressure of tolunitrile introduced is preferably in the range of approximately $1\times10^{-5}$ Pa to $1\times10^{-2}$ Pa, though it is slightly affected by the shape of a vacuum chamber, members used in the vacuum chamber, and so on.

Figure 11A:
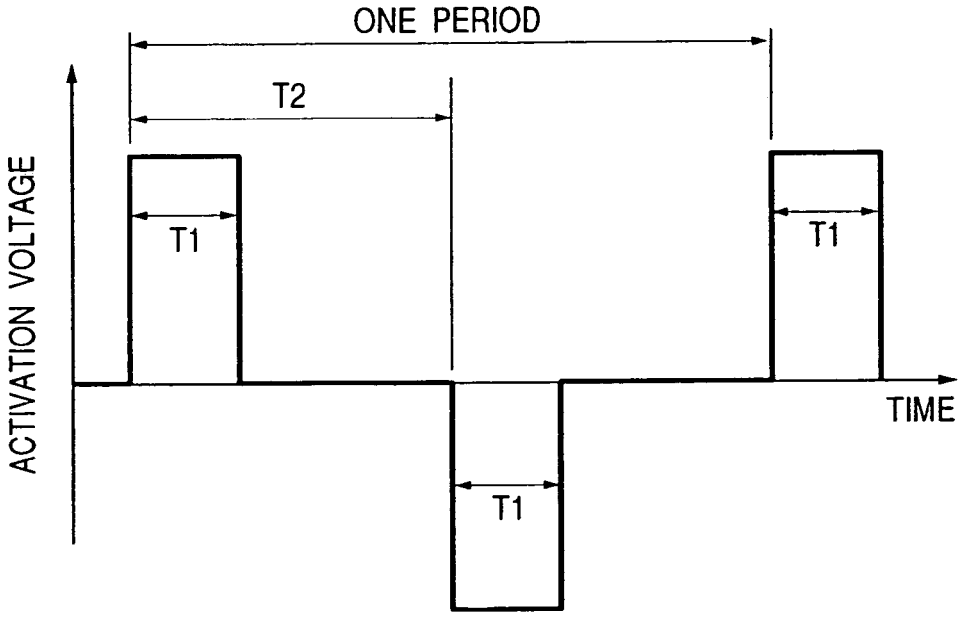
FIGS. 11A and 11B are graphs showing examples of activation voltage.
Figure 11B:
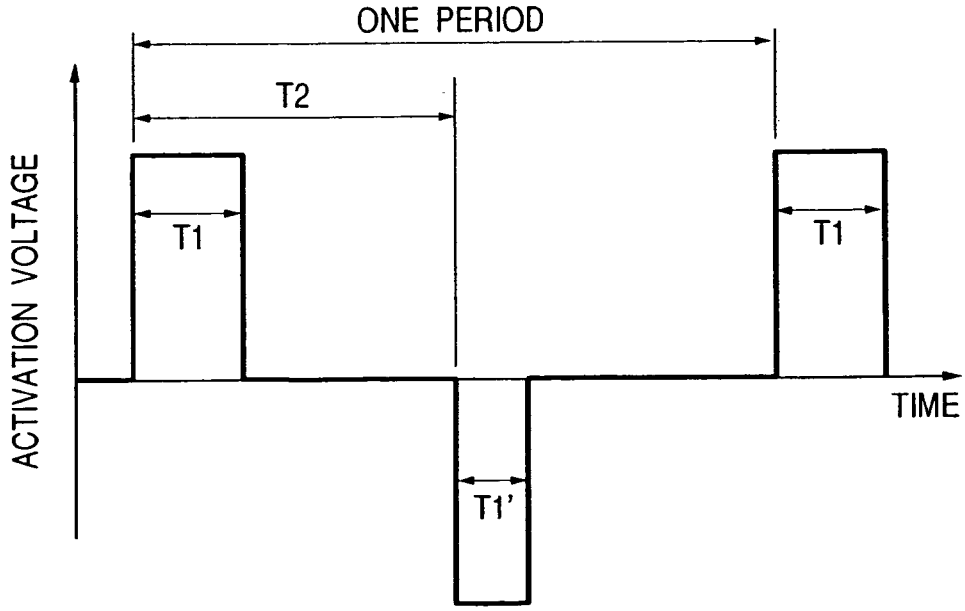

FIGS. 11A and 11B show preferred examples of the voltage applied in the activation step. The maximum voltage applied is properly selected in the range of 10 to 20 V.

In FIG. 11A, T1 represents the pulse width of positive and negative pulses in the voltage waveform, and T2 the pulse spacing, and voltage values are set so that absolute values of positive and negative pulses become equal to each other. In FIG. 11B, T1 and T1' represent pulse widths of positive and negative pulses, respectively, in the voltage waveform, T2 the pulse spacing, T1>T1', and voltage values are set so that absolute values of positive and negative pulses become equal to each other.

In this operation, energization is terminated when the emission current Ie becomes almost saturated after a lapse of about 60 minutes, and the slow leak valve is closed, thereby ending the activation operation.

The electron-emitting device as shown in FIGS. 17A, 17B can be fabricated through the above steps.

The fundamental characteristics of the electron-emitting device fabricated in the device structure and by the production method as described above will be described referring to FIGS. 9 and 10.

Figure 9:
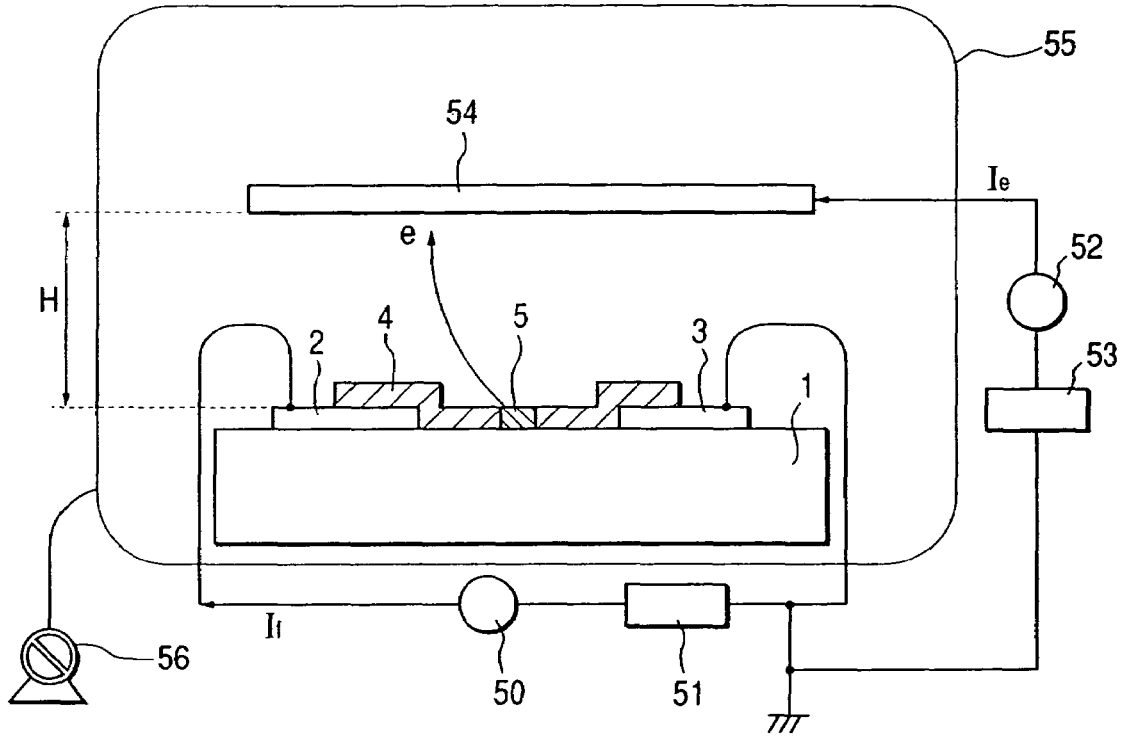
FIG. 9 is an illustration schematically showing a system for measuring characteristics of the electron-emitting device according to the present invention.

FIG. 9 is a schematic illustration of a measurement-evaluation system for measuring the electron emission characteristics of the electron-emitting device having the aforementioned configuration. In FIG. 9, numeral 51 designates a power supply for supplying the device voltage Vf to the device, 50 an ammeter for measuring the device current If flowing through the electrode part of the device, 54 an anode for capturing the emission current Ie emitted from the electron-emitting region of the device, 53 a high voltage supply for supplying a voltage to the anode 54, and 52 an ammeter for measuring the emission current Ie emitted from the electron-emitting region of the device.

For measuring the device current If flowing between the device electrodes 2, 3 of the electron-emitting device, and the emission current Ie to the anode, the power supply 51 and the ammeter 50 are connected to the device electrodes 2, 3 and the anode 54 coupled to the power supply 53 and the ammeter 52 is placed above the electron-emitting device.

This electron-emitting device and the anode 54 are set in a vacuum chamber 55, and the vacuum chamber is equipped with devices necessary for the vacuum chamber, such as an evacuation pump 56, a vacuum gage, etc., so as to enable measurement and evaluation of the device under a desired vacuum. The measurement was carried out under the conditions that the voltage of the anode 54 was in the range of 1 kV to 10 kV and the distance H between the anode and the electron-emitting device was in the range of 2 mm to 8 mm.

Figure 10:
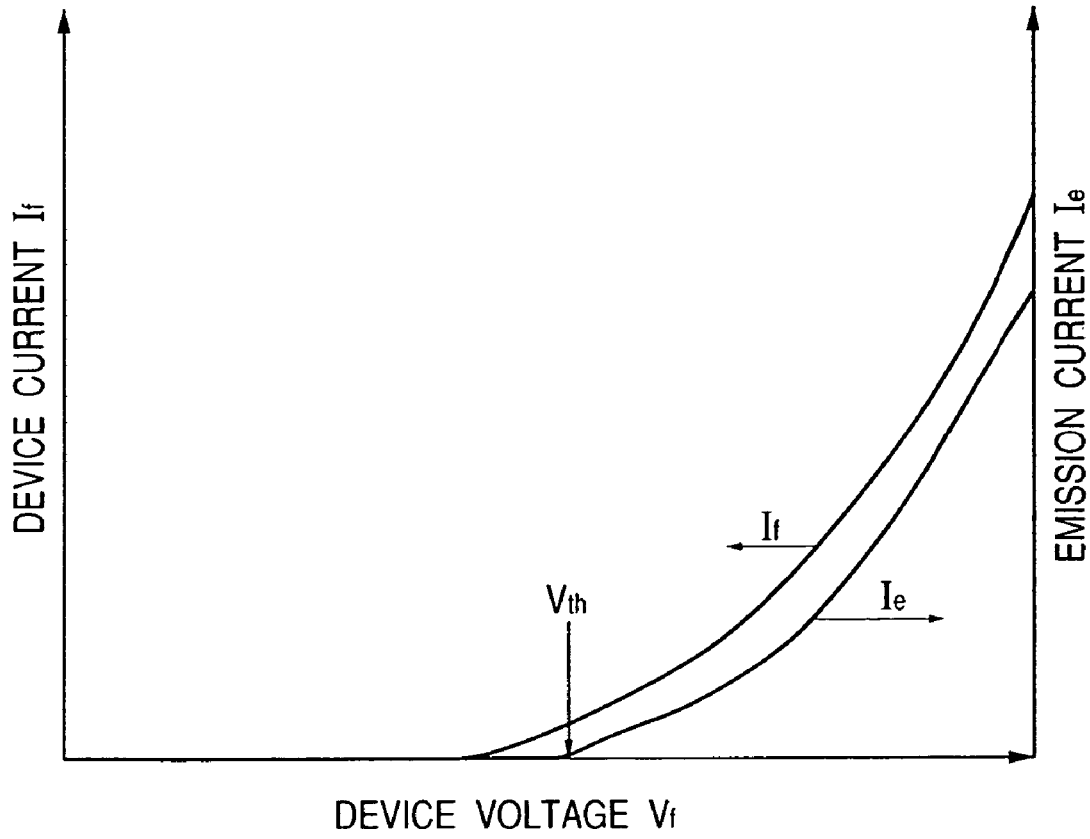
FIG. 10 is a graph showing the relationship of device voltage with device current and emission current of the surface conduction electron-emitting device according to the present invention.

FIG. 10 shows a typical example of relationship of the device voltage $V_f$ with the emission current Ie and the device current $I_f$ measured by the measurement-evaluation system shown in FIG. 9. The emission current Ie and the device current If are largely different in magnitude, but they are illustrated in arbitrary units on the vertical axis of linear scale in FIG. 10, for qualitative comparison of changes of $I_f$ and $I_e$.

The electron-emitting device has three features as to the emission current Ie.

First, as also apparent from FIG. 10, the device rapidly increases the emission current $I_e$ with application of the device voltage not less than a certain voltage (referred to as a threshold voltage, $V_{th}$ in FIG. 10), while little emission current $I_e$ is detected below the threshold voltage $V_{th}$. Namely, it is seen that the device demonstrates characteristics as a non-linear device having the clear threshold voltage $V_{th}$ against the emission current $I_e$.

Secondly, the emission current Ie is dependent upon the device voltage $V_f$, and thus the emission current Ie can be controlled by the device voltage $V_f$.

Thirdly, an emission charge captured by the anode 54 is dependent upon a time of application of the device voltage $V_f$. Namely, the amount of the charge captured by the anode 54 can be controlled by the time of application of the device voltage $V_f$.

Figure 2:
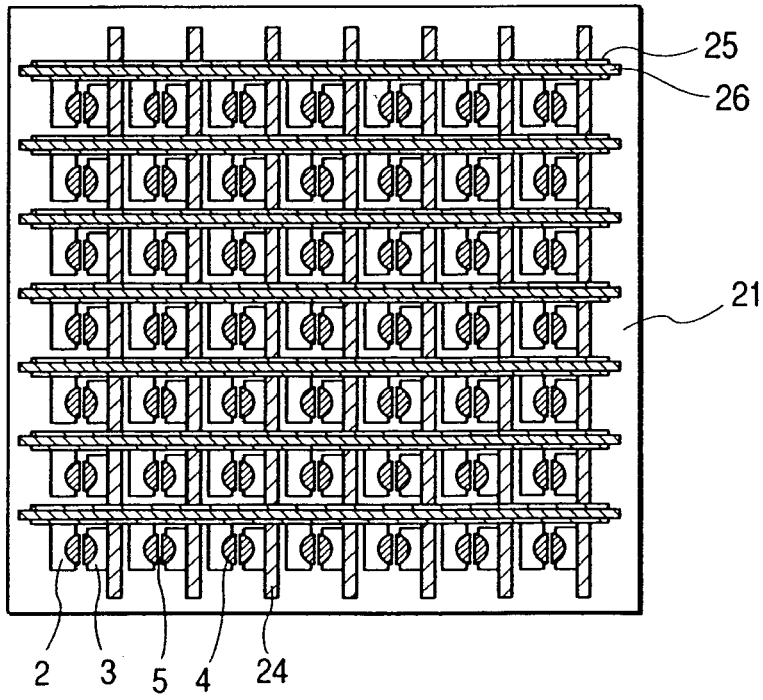
FIG. 2 is a plan view showing a basic configuration of an electron source substrate, which is a constitutive member of the image display apparatus of the present invention.
Figure 3:
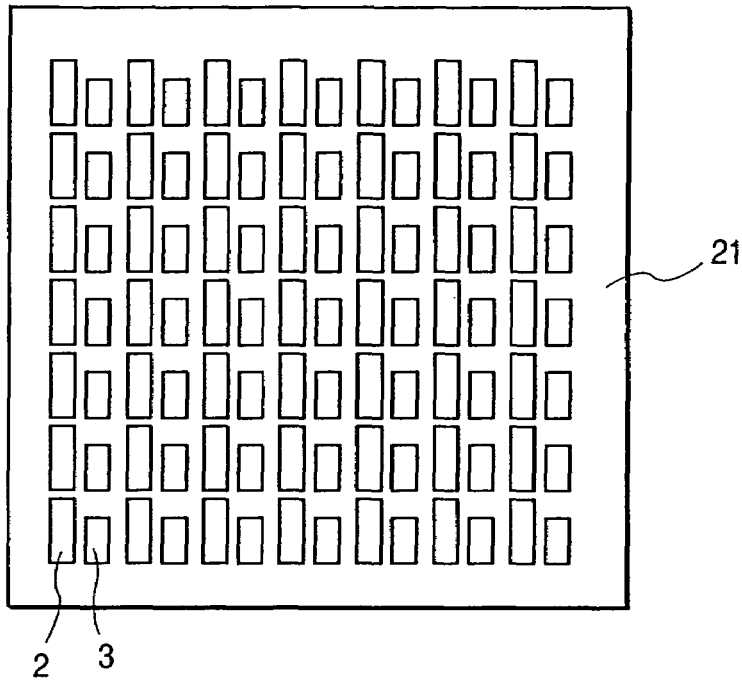
FIG. 3 is an illustration for explaining a production step of the electron source substrate of FIG. 2.
Figure 4:
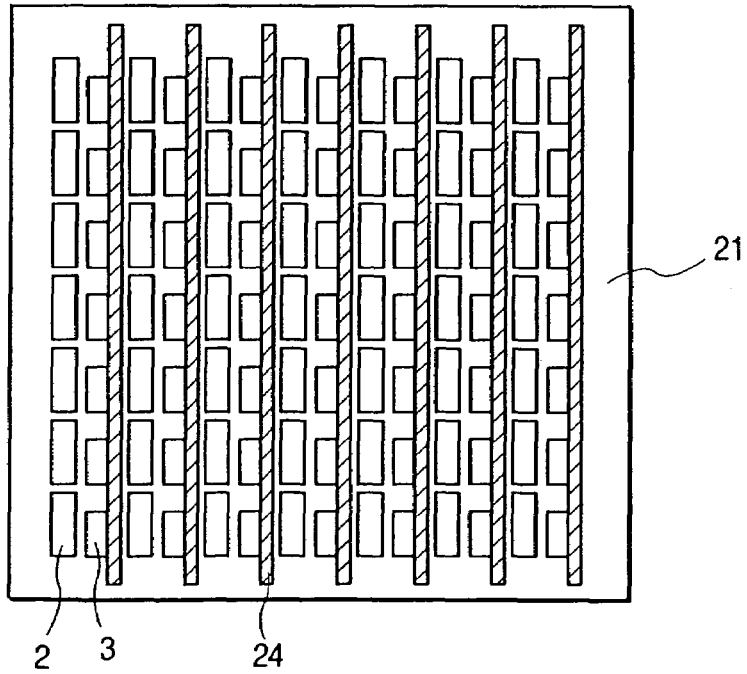
FIG. 4 is an illustration for explaining a production step of the electron source substrate of FIG. 2.
Figure 5:
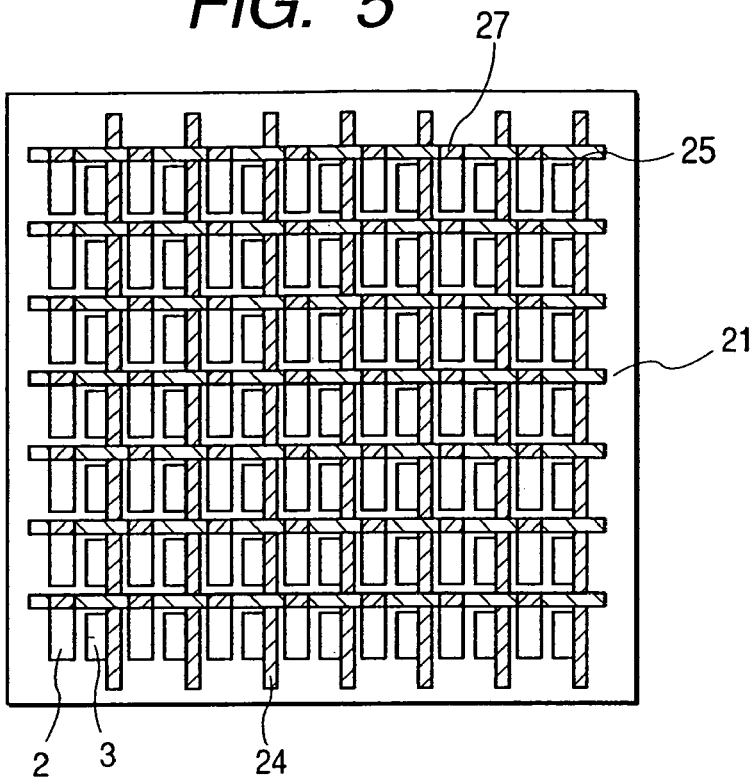
FIG. 5 is an illustration for explaining a production step of the electron source substrate of FIG. 2.
Figure 6:
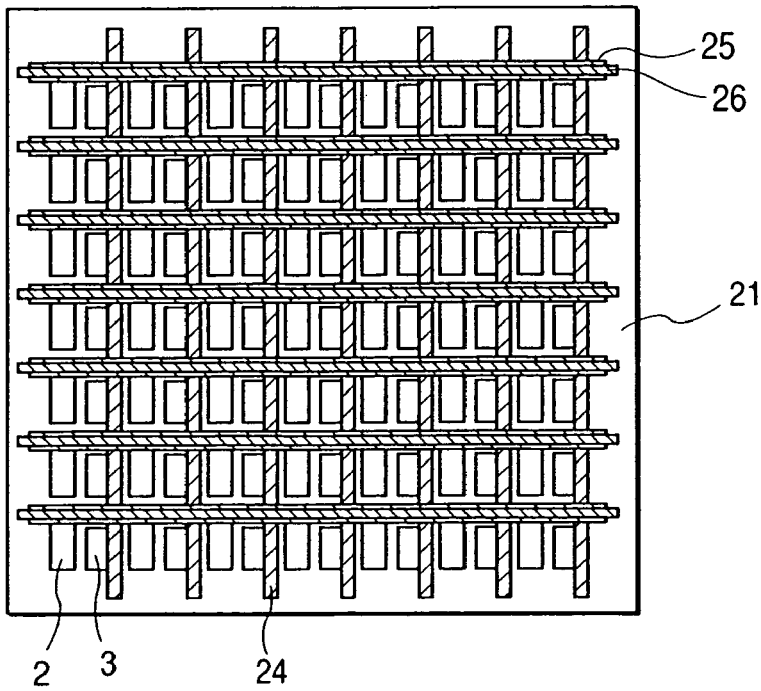
FIG. 6 is an illustration for explaining a production step of the electron source substrate of FIG. 2.

For example, a configuration as shown in FIG. 2 can be contemplated as a basic configuration of the electron source substrate according to the present embodiment. In this electron source substrate, a plurality of Y-directional wires (lower wires) 24 are formed on a substrate 21, a plurality of X-directional wires (upper wires) 26 are formed through an insulating layer 25 on the X-directional wires 24, and electron-emitting devices, each including an electrode pair (device electrodes 2, 3), are placed near respective intersections between the two-directional wires.

The image display apparatus of the present embodiment is constructed using the electron source substrate as exemplified in FIG. 2, and the basic structure thereof will be described below referring to FIG. 12.

Figure 12:
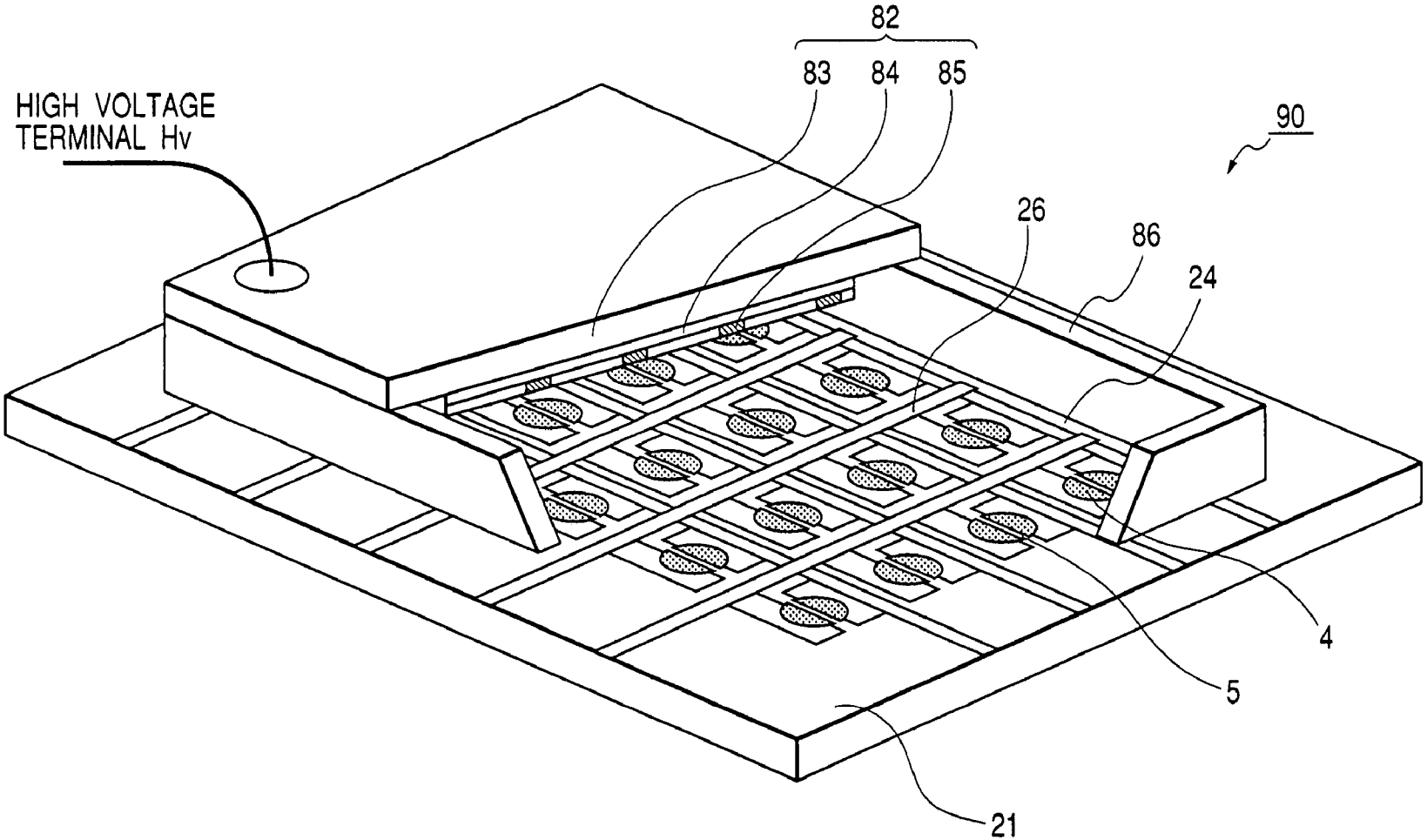
FIG. 12 is a perspective view schematically showing a configuration example of the image display apparatus according to the present invention.

In FIG. 12, numeral 21 designates the foregoing electron source substrate, 82 a face plate in which a fluorescent film 84, a metal back 85, etc. are formed on an internal surface of glass substrate 83, and 86 a support frame. The electron source substrate 21, support frame 86, and face plate 82 are bonded with the joining members like the In films or the like, the frit glass, etc. as described previously, and the assembly is baked at 400 to 500° C. for ten or more minutes to effect seal bonding, thereby forming an envelope 90.

By placing an unrepresented support called a spacer between the face plate 82 and the electron source substrate 21, it is also feasible to construct the envelope 90 with sufficient strength against the atmospheric pressure even in the case of a large-area panel.

The image display apparatus of the present embodiment is most characterized by the configuration in the vacuum seal bonding portion; when the electron source substrate 21 and the face plate 82 are joined through the joining members of In films or the like to constitute the envelope 90 with the predetermined gap between the electron source substrate 21 and the face plate 82, the holding member for the joining member, having the melting point higher than the softening temperature of the joining member and having high wettability to the joining member, is provided inside the joining member.

Desirable metals for the holding member for the joining member are solid metals resistant to oxidation; for example, first candidates include noble metal materials such as silver, gold, platinum, and so on; copper, chromium, nickel, or the like coated with gold. Furthermore, desirable materials also include materials that reduce the surface oxide films of the joining members of the In films or the like as described previously. Specifically, such materials include hydrogen storing metals such as titanium, nickel, iron, and the like, or hydrogen storing alloys that are preliminarily made to absorb hydrogen at room temperature in a hydrogen atmosphere. When the holding member is made of one of such materials, hydrogen is released at high temperature during the seal bonding to react with oxygen in the oxide films, thus promoting the reduction reaction of the oxide films. These noble metal materials and hydrogen storing metals generally demonstrate high wettability to liquid In, which is a preferable property.

Specific configuration examples, action, etc. of the vacuum seal bonding portion in the image display apparatus of the present embodiment will be detailed in Examples later.

Figure 13A:
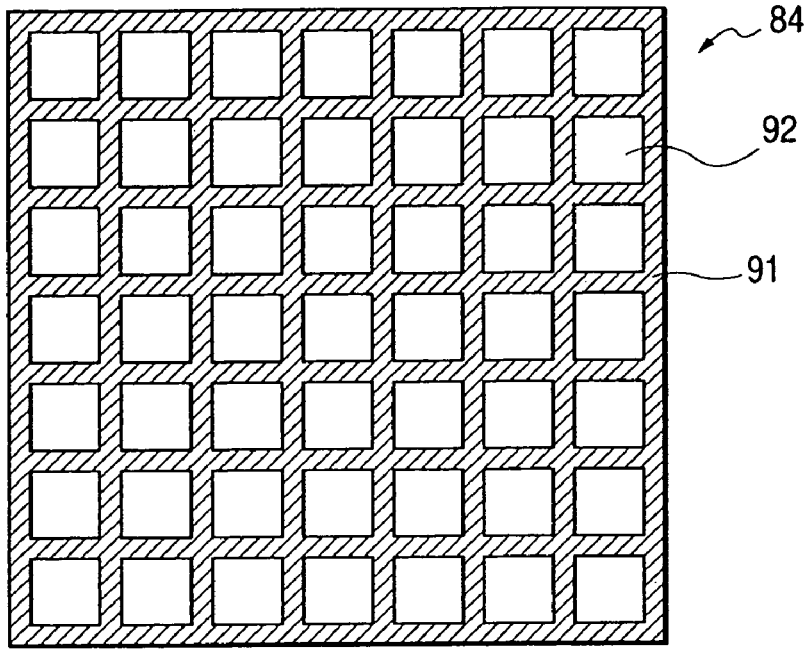
FIGS. 13A and 13B are diagrams schematically showing examples of the fluorescent film in the image display apparatus according to the present invention.
Figure 13B:
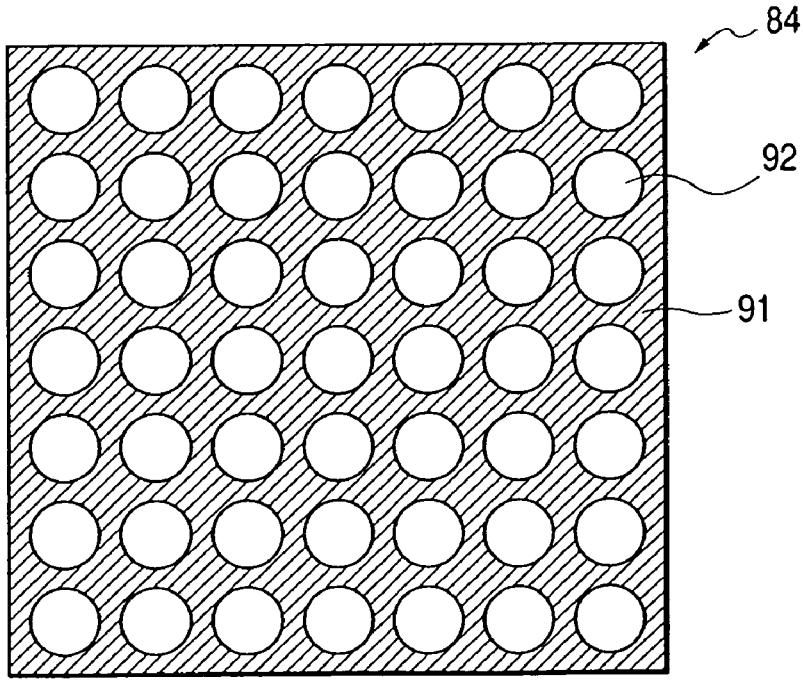

FIGS. 13A, 13B are schematic illustrations for explaining the fluorescent film 84 provided on the face plate 82. The fluorescent film 84 is comprised of only a phosphor in the monochrome case, but a color fluorescent film is comprised of a black conductor 91 called black stripes or a black matrix, depending upon a pattern of phosphors, and phosphors 92. The purposes for provision of the black stripes or the black matrix are to make color mixture or the like obscure by blackening regions between the phosphors 92 of the three primary colors necessary for the color display and to suppress decrease of contrast due to reflection of outside light on the fluorescent film 84.

The metal back 85 is normally placed on the internal surface side of the fluorescent film 84. The metal back is provided for the purposes of enhancing the luminance by specular reflection of light traveling inward out of emission of the phosphors, toward the face plate 82, acting as an anode for application of an electron beam accelerating voltage, and so on. The metal back can be fabricated by first forming the fluorescent film, thereafter performing an operation of smoothing the internal surface of the fluorescent film (normally called filming), and then depositing an Al film thereon by vacuum evaporation or the like.

For execution of the foregoing seal bonding, the electron-emitting devices need to be aligned with the respective color phosphors in the color case and it is thus necessary to implement adequate alignment by a butting method of the upper and lower substrates or the like.

The degree of vacuum necessary for the seal bonding is approximately $10^{-5}$ Pa, and getter processing is also carried out in certain cases, in order to maintain the degree of vacuum after the sealing of the envelope 90.

The getters as described above are classified under evaporable and nonevaporable getters. An evaporable getter is such a getter that an alloy containing the main component of Ba or the like is heated by energization or high frequency in the envelope 90 to form a deposited film on the internal wall of the vessel (getter flash) and the active getter metal surface adsorbs gas evolved inside to maintain the high vacuum.

On the other hand, a nonevaporable getter is such a getter that a getter material of Ti, Zr; V, Al, Fe, or the like is placed and heated in vacuum to effect "getter activation" to yield the gas adsorbing property, thereby adsorbing the evolved gas.

In general, the flat-panel display apparatus is too thin to secure sufficient areas for the setting of the evaporable getter for maintaining the vacuum and the flash for instantaneous discharge, and thus they are installed near the support frame outside the image display area. Therefore, the conductance is small between the central area of the image display and the getter installation region, so that the effective exhaust speed becomes low in the central region of the electron-emitting devices and phosphors.

In the image display apparatus having the electron source and the image display member, a portion evolving undesired gas is mainly the image display region irradiated with electron beams. For this reason, in order to maintain the phosphors and the electron source in high vacuum, it is necessary to place the nonevaporable getter near the phosphors and the electron source-that are emission sources of gas.

According to the fundamental characteristics of the surface conduction electron-emitting device in the present embodiment described previously, electrons emitted from the electron-emitting region are controlled by the peak height and width of pulsed voltage placed between the facing electrodes in the range of not less than the threshold voltage, and amounts of electric current are also controlled by intermediate values thereof, thereby enabling halftone display.

In the case where a number of electron-emitting devices are placed, it is feasible to apply the voltage properly to an arbitrary device, by determining a select line by a scanning line signal of each line and properly applying the pulsed voltage to the individual devices through each information signal line. This permits each device to be turned on.

Methods of modulating the electron-emitting devices according to halftone input signals include a voltage modulation method and a pulse width modulation method.

In the image display apparatus of the present embodiment, the joining-member-holding member having the melting point higher than the softening temperature of the joining member and having high wettability to the joining member is provided inside the joining member of In film or the like joining the electron source substrate 21 to the face plate 82, whereby it is feasible to suppress the occurrence of vacuum leak extremely effectively in the joining part and to display images with good quality over long periods of time.

EXAMPLES

Examples of the present invention will be described below, but it is noted that the present invention is by no means intended to be limited to these examples.

Example 1

The present example is an example in which the electron source substrate was fabricated by connecting a number of surface conduction electron-emitting devices as shown in FIG. 2, by matrix wiring and in which the image display apparatus as shown in FIG. 12 was produced using this electron source substrate.

First, a method of producing the electron source substrate in the present example will be described with reference to FIGS. 2 to 7.

(Formation of Device Electrodes)

The substrate was one prepared by applying a silica ($SiO_2$) film 100 nm thick as a sodium blocking layer on a 2.8 mm-thick glass of PD-200 (available from Asahi Glass Co., Ltd.) being an electric glass for plasma display and containing only a small amount of alkali components, and baking it.

On this glass substrate, a titanium (Ti) layer (5 nm thick) was first deposited as an underlying layer by sputtering, and a platinum (Pt) layer (40 nm thick) was then deposited thereon. Thereafter, the deposited films were patterned by the sequential photolithography process including steps of applying a photoresist, and performing exposure, development, and etching thereof, to form the device electrodes 2, 3 (cf. FIG. 3). In the present example the spacing L between the device electrodes was 10 μm and the facing length W of the electrodes 100 μm.

(Formation of Lower Wires)

The material of the wires desirably has the resistance low enough to supply almost uniform voltage to the many surface conduction devices, and the material, film thickness, width, etc. of the wires are properly set.

The Y-directional wires (lower wires) 24 as common wires were formed in line patterns so as to contact one-side device electrodes 3 and connect them. The material was Ag photo-paste ink, and it was printed by screen printing, then dried, and exposed and developed in the predetermined patterns. After this, the substrate was baked at temperatures around 480° C. to form the lower wires 24 (cf. FIG. 4). The thickness of the lower wires 24 was about 10 μm and the width about 50 μm. Since the terminal ends were used as wiring extraction electrodes, they were formed in a larger line width.

(Formation of Insulating Layers)

Insulating layers 25 are formed in order to insulating the upper and lower wires from each other. The insulating layers 25 were formed in such a way that they were formed below the X-directional wires (upper wires) described hereinafter, so as to cover the intersections with the Y-directional wires (lower wires) 24 formed previously and that contact holes 27 were perforated in the connection regions corresponding to the respective devices so as to enable electrical connection between the X-directional wires (upper wires) and the device electrodes 2 (cf. FIG. 5).

Specifically, a photosensitive glass paste containing the main component of PbO was printed by screen printing and thereafter it was exposed and developed. This process was repeated four times and the paste was finally baked at temperatures around 480° C. The insulating layers 25 were formed in the total thickness of about 30 μm and in the width of 150 μm.

(Formation of Upper Wires)

Ag paste ink was printed on the insulating layers 25 formed previously, by screen printing, and dried thereafter. The same process was repeated thereon to form two coats, and then the coats were baked at temperatures around 480° C. to form the X-directional wires (upper wires) 26 (cf. FIG. 6). The X-directional wires 26 intersect with the Y-directional wires 24 with the insulating layers 25 between, and are connected to the device electrodes 2 in the portions of the contact holes 27 provided in the insulating layers 25.

The X-directional wires 26 act as scan electrodes in driving. The thickness of the X-directional wires 26 is approximately 15 μm. Although not illustrated, outgoing lines to external drive circuits were also formed by a method similar to this process.

The substrate with the XY matrix wiring was formed in this way.

(Formation of Electroconductive Films)

Then the above substrate was cleaned well and thereafter its surface was treated with a solution containing a water repellent agent so that the surface became hydrophobic. This was done for the purpose of placing an aqueous solution for formation of the electroconductive films applied hereinafter, with a moderate spread on the device electrodes. The water repellent agent used herein was a DDS (dimethyldiethoxysilane) solution, and it was sprayed onto the substrate by spraying, and dried by hot air at 120° C.

Then the electroconductive films 4 were formed between the device electrodes 2, 3. This step will be described using the schematic illustrations of FIGS. 7A to 7C. In order to compensate for two-dimensional variation in the individual device electrodes on the substrate 21, displacements of patterns were measured at several points on the substrate, deviation amounts at points between measurement points were determined by linear approximation, and the electroconductive-film-forming material was applied based on correction for the positional deviations thus determined, whereby the material was accurately applied to corresponding positions without positional deviations at all the pixels.

Figure 7A:
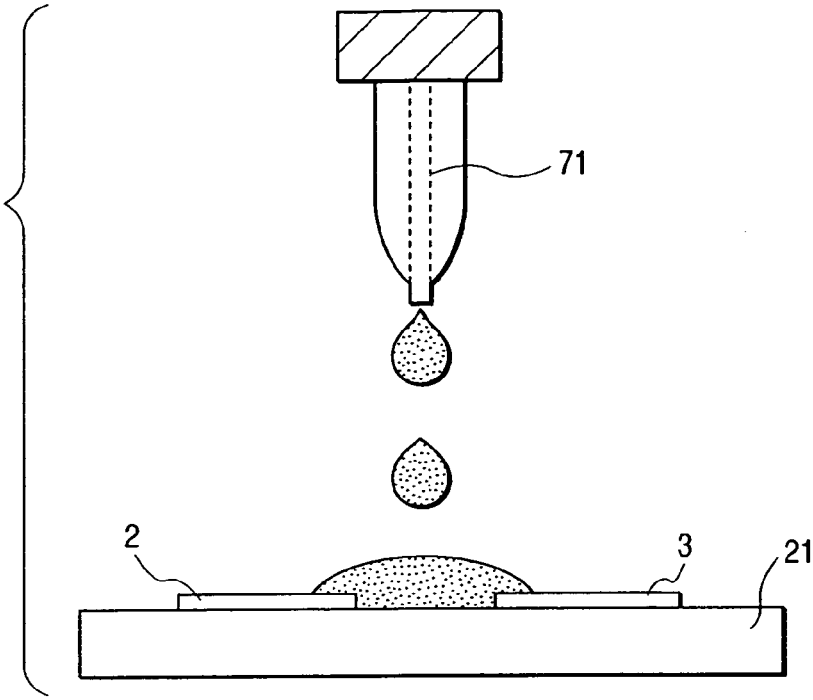
FIGS. 7A, 7B, and 7C are illustrations for explaining production steps of the electron source substrate of FIG. 2.

In the present example, in order to obtain palladium films as the electroconductive films 4, a palladium-proline complex was first dissolved 0.15% by weight in an aqueous solution consisting of water 85:isopropyl alcohol (IPA) 15, thereby obtaining an organic palladium-containing solution. In addition thereto, a small amount of an additive was added. Droplets of this solution were delivered to between the device electrodes, using an ink jet ejecting device incorporating piezoelectric devices, as droplet delivering means 71, while being adjusted to form each dot in the dot size of 60 μm (FIG. 7A).

Figure 7B:
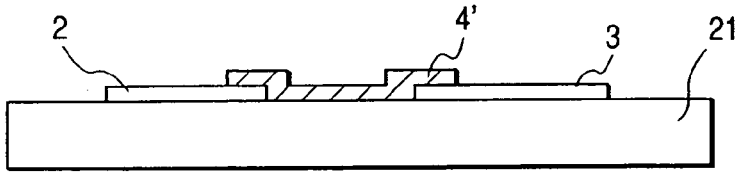

Thereafter, this substrate was subjected to bake processing at 350° C. for ten minutes, thereby forming the electroconductive films 4' of palladium oxide (PdO) (FIG. 7B).

(Forming Step)

Figure 7C:
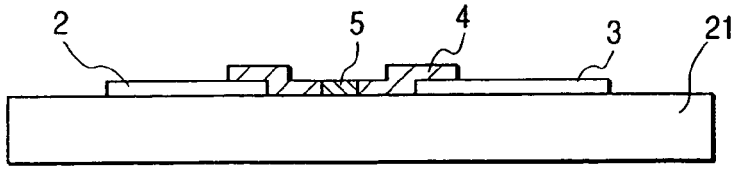

In the present step called forming, the electroconductive films 4' were then subjected to the energization operation to form a fissure inside, thereby forming the electron-emitting regions 5 (FIG. 7C).

A specific method is as follows: a hoodlike lid is placed so as to cover the entire substrate except for the outgoing electrode portions around the substrate 21 to make a vacuum space inside together with the substrate 21, the voltage from the external power supply is applied through the electrode terminal portions to between the two directional wires 24, 26 to effect energization between the device electrodes 2, 3, so as to locally break, deform, or modulate the electroconductive films 4', thereby forming the electron-emitting regions 5 in an electrically high resistance state.

When the energization heating is implemented under a vacuum atmosphere containing a small amount of hydrogen gas in the above process, hydrogen promotes reduction to change the electroconductive films 4' of palladium oxide PdO into the electroconductive films 4 of palladium Pd.

Reduction constriction of the films during this change makes a fissure (gap) in part, and the position and shape of the fissure made are greatly affected by uniformity of the original films. In order to suppress variation in characteristics of many devices, it is most desirable that the fissure be made in the central region of the electroconductive films 4 and be as linear as possible.

Electrons can be emitted under a predetermined voltage from the vicinity of the fissures formed by the above forming, but the emission efficiency is still very low in the current condition.

The resultant electroconductive films 4 have the resistance Rs in the range of $10^2$ to $10^7$ Ω.

The waveform of the voltage used in the forming operation was the triangular pulse waveform as shown in FIG. 8B, in which T1 was 0.1 msec and T2 50 msec. The applied voltage was increased from 0.1 V by steps of about 0.1 V per 5 sec. The end of the energization forming operation-was determined as follows: the electric current flowing through the devices during application of the pulse voltage was measured, the resistance was calculated based thereon, and the energization forming was terminated when the resistance became 1000 or more times the resistance before the forming operation.

(Activation Step)

Just as in the case of the foregoing forming operation, a hoodlike lid was placed to form a vacuum space inside together with the substrate 21, and the pulse voltage from the outside was repeatedly applied through the two directional wires 24, 26 to between the device electrodes 2, 3, thereby performing the activation. Then a gas containing carbon atoms was introduced to deposit carbon or a carbon compound deriving therefrom, as carbon films near the fissures.

Tolunitrile was used as a carbon source in the present step, and it was introduced through a slow leak valve into the vacuum space to maintain the pressure at $1.3\times10^{-4}$ Pa.

FIGS. 11A and 11B show preferred examples of application of the voltage used in the activation step. The maximum voltage applied is properly selected in the range of 10 to 20 V.

In FIG. 11A, T1 is the pulse width of positive and negative pulses in the voltage waveform, T2 the pulse spacing, and the voltage values are set so that the absolute values of the positive and negative pulses become equal to each other. In FIG. 11B, T1 and T1' are the pulse widths of the positive and negative pulses, respectively, in the voltage waveform, T2 the pulse spacing, T1>T1', and the voltage values are set so that the absolute values of positive and negative pulses become equal to each other.

In this operation, the positive voltage is applied to the device electrodes 3, and the device current If is positive in the direction of flow from the device electrode 3 to the device electrode 2. In the present example, energization was terminated when the emission current Ie became approximately saturated after a lapse of about sixty minutes. The slow leak valve was closed to terminate the activation operation.

The above steps ended in making the electron source substrate in which a number of electron-emitting devices were matrix-wired on the substrate.

(Evaluation of Characteristics of Electron Source Substrate)

The electron emission characteristics of the electron source substrate fabricated in the device structure and the production method as described above, were measured using the system as shown in FIG. 9. The results of the measurement were as follows; the emission current Ie at the voltage of 12 V applied between the device electrodes was 0.6 μA on average and the electron emission efficiency 0.15% on average. Uniformity was also good among the devices and the variation in Ie among the devices was as low as 5%.

Then the display panel (envelope 90) as shown in FIG. 12 was fabricated using the electron source substrate produced as described above.

FIG. 1 is an illustration showing the schematic sectional structure of the peripheral region of the display panel (envelope 90) according to the present example.

In FIG. 1, numeral 21 denotes the foregoing electron source substrate with a number of electron-emitting devices therein, which will be referred to as a rear plate. Numeral 82 designates a face plate in which the fluorescent film 84 and metal back 85 are formed on the internal surface of the glass substrate 83 (cf. FIG. 12). Numeral 86 indicates a support frame, 203 In films (joining members), and 205 an In-film-holding member (joining-member-holding member).

The glass substrate 83 forming the face plate 82 was the material of PD-200 (available from Asahi Glass Co., Ltd.) containing only a small amount of alkali components and being an electric glass for plasma display, as in the case of the rear plate 21. In the case of this glass material, no coloring phenomenon of glass occurs, and the thickness of about 3 mm is enough to achieve the shielding effect of restraining leakage of soft X-rays secondarily made, even in the operation at the acceleration voltage of 10 or more kV.

A support called spacer 201 is placed between the face plate 82 and the rear plate 21. This configuration allows the envelope 90 to be constructed with sufficient strength against the atmospheric pressure even in the case of a large-area panel.

The spacer 201 and the support frame 86 are bonded to the rear plate 21 with frit glass 202 and they are fixed thereto by baking at 400-500° C. for ten or more minutes. The heights of the respective members are determined so that the height of the spacer 201 becomes a little higher than the height of the support frame 86 bonded to the rear plate 21 with frit glass 202. This setting determines the thickness of the In films 203 after joined. Accordingly, the spacer 201 also functions as a thickness defining member for the In films 203.

The support frame 86 and the face plate 82 are bonded through the In films 203. The In films 203 are made of metal In, because it releases little gas even at high temperatures and has a low melting point. When the joining members are a metal or an alloy, they contain neither a solvent nor a binder, and they release very little emission gas when melted at the melting point. Therefore, they are desirable materials for the joining members.

In order to enhance adhesion at the interfaces, underlying layers 204 are provided at portions of the support frame 86 and face plate 82 where the In films 203 are bonded. In the present example, silver is used, because it has high wettability to the metal In. The underlying layers 204 of silver can be readily patterned by screen printing of a silver paste or the like. Thin films of other metal that can be readily formed by vacuum evaporation, such as ITO or Pt, also suffice for the underlying layers 204.

The In-film-holding member 205 is placed inside the In films 203. For explaining the function of the In-film-holding member 205, the seal bonding method of the image display apparatus according to the present example will be described referring to FIGS. 14 and 15.

Before joining between the face plate 82 and the rear plate 21, i.e., before the seal bonding, the In films 203 are preliminarily patterned. A method of forming the patterned In film 203 on the face plate 82 will be described with FIG. 14, and the same also applies to formation of the In film 203 on the support frame 86 bonded to the rear plate 21.

First, the face plate 82 is kept in a hot state at a temperature enough to maintain the wettability to molten In. The sufficient temperature is not less than 100° C. The silver paste used as the underlying layer 204 is a porous film including a lot of voids inside, though having high adhesion to glass. Therefore, it is necessary to make molten In penetrate well into the interior of the underlying layer 204. Molten In at a temperature higher than the melting point thereof is thus soldered to the underlying layer 204 by an ultrasonic soldering iron 206 to form the In film 203. The molten In can be liquid In melted at the temperature over 200° C. If the underlying layer 204 is not impregnated well with In, it will cause vacuum leakage. The metal In is replenished as needed, to the joining part from an unrepresented In replenishing means, in order to supply it constantly to the tip of the soldering iron.

The thickness of the In film 203 is determined by adjusting the moving speed of the ultrasonic soldering iron 206 and the supply amount of In so that the total thickness of the In films formed on the face plate side and on the rear plate side (on the support frame 86) becomes sufficiently larger than the thickness of the In films 203 after joined. In the present example, the thickness of the In films 203 after the seal bonding is 300 μm, and the In films are formed each in the same thickness of 300 μm on the both face plate and rear plate sides.

Figure 14:
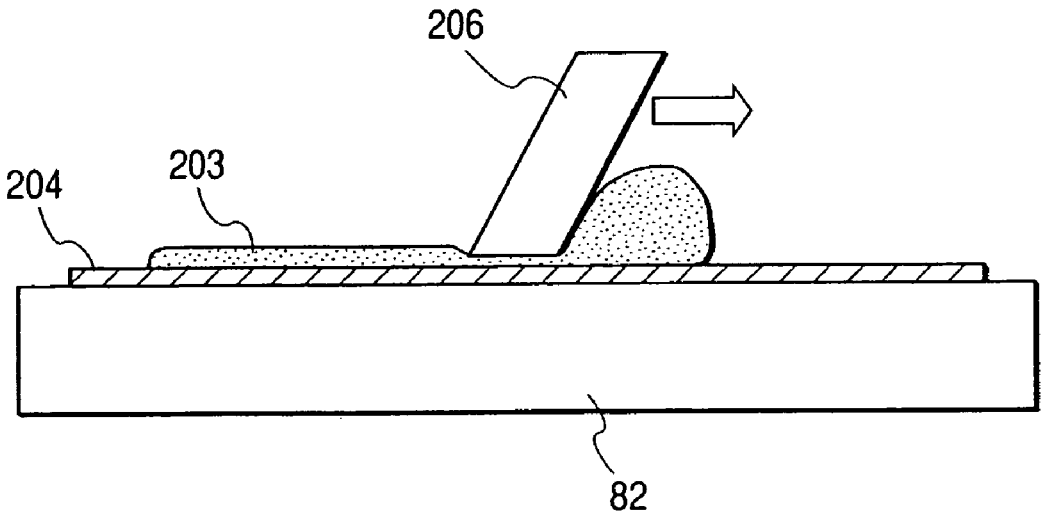
FIG. 14 is an illustration for explaining the seal bonding method of the display panel (envelope) according to Example 1 of the present invention.
Figure 15:
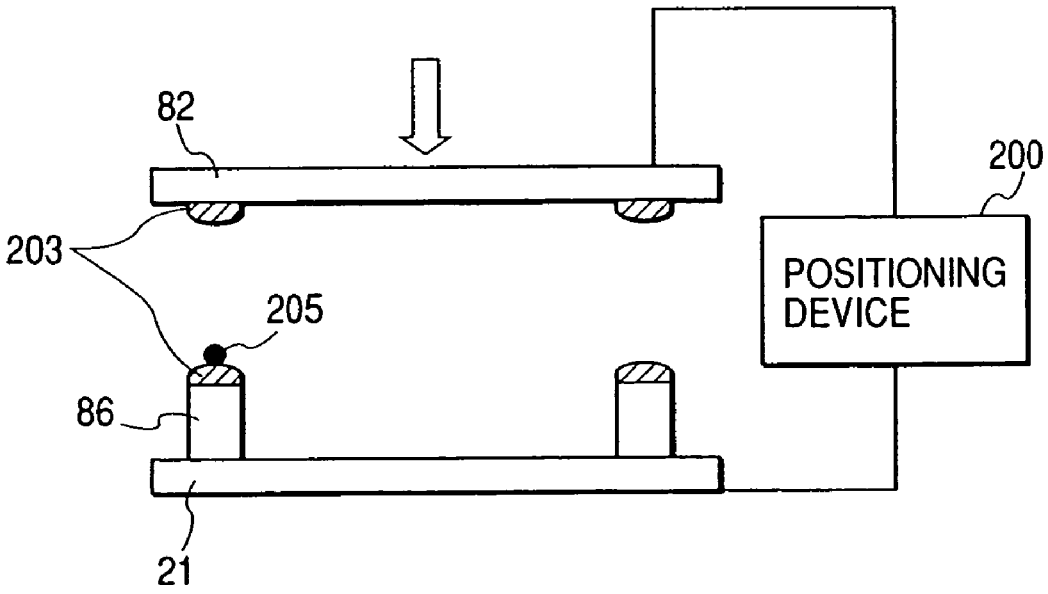
FIG. 15 is an illustration for explaining the seal bonding method of the display panel (envelope) according to Example 1 of the present invention.

After the In films 203 are formed on the both substrates of the face plate 82 and the rear plate 81 by the forming method shown in FIG. 14, the panels are joined by the seal bonding method shown in FIG. 15.

First, the two substrates are held and heated in vacuum in a state in which a predetermined spacing is maintained between the facing face plate 82 and rear plate 21. The substrates are baked in vacuum at high temperatures over 300° C. so that the substrates evolve gas and an adequate vacuum degree is achieved inside the panel at room temperature thereafter. At this point, the In films 203 are in a molten state, and sufficient leveling is done for the both substrates in order to prevent molten In from flowing out. During the vacuum bake of the substrates, penetration of In into the foregoing underlying layers 204 proceeds further, to form joint interfaces with satisfactory seal performance.

After the vacuum bake, the temperature is decreased to the vicinity of the melting point of In and the spacing between the face plate 82 and the rear plate 21 is gradually decreased by a positioning device 200 to implement joining of the two substrates, i.e., seal bonding. The reason why the temperature is decreased to the vicinity of the melting point is that the flowability of liquid In in the molten state is lowered to prevent unwanted flow or overflow during the joining operation.

An issue herein is a state of the joint interface of the In films 203 formed on the face plate side and on the rear plate side. In the forming method of the In film 203 described with FIG. 14, surface oxide films are formed therein, the melting point of the oxide films is high (over 800° C.), and they remain in a crystalline solid state; therefore, they could maintain their respective surface shapes during the seal bonding operation. Namely, there is a possibility that they remain as oxide film interfaces in the In films to make a leak path responsible for the vacuum leakage. In practice, the thickness of the oxide films is thin, and thus the oxide films are readily broken by stress during the joining operation. Thus liquid In flows out of the interior to undergo convection, so that the remaining oxide poses no problem in most cases. However, there is a risk of a leak path made at portions where the oxide films are made locally thick in the formation of In films and where the thickness of the In films is insufficient.

In the present invention, in order to solve the problem of the oxide films responsible for the vacuum leakage, the In-film-holding member 205 is put into the joint surfaces during the seal bonding operation. The In-film-holding member 205 is made of a material with high wettability to In in order to prevent the liquid In melted during the substrate vacuum bake from being repelled to flow out. The In-film-holding member 205 with high wettability can hold the liquid In and thus presents the effect of preventing the flowing-out of In even if the leveling degree of the substrates is insufficient.

In the present example the In-film-holding member 205 is of spherical shape and is buried into the In film on the rear plate side (on the support frame 86), and it is put into a seal bonding device in a state in which the holding member 205 is maintained at the initial position.

Furthermore, another function of the In-film-holding member 205 is an effect of breaking the oxide film of In film 203 on the opposite face plate 82 during the joining in the molten state of In. As described previously, the oxide films are crystalline solid but are sufficiently thinner than bulk. Therefore, the stress imparted from the In-film-holding member 205 during the joining operation is a pressure enough to break the oxide film. Even if the surface oxide film is not broken throughout the entire joint surface, but if the oxide film is locally lost, the liquid In will undergo convection from there as a starting point and force the oxide film out from the joint surface to the peripheral region together with an excess amount of liquid In, thus achieving the effect of excluding the oxide film from the joint surface.

A material of the In-film-holding-member 205 is desirably a solid metal resistant to oxidation. The reason is that when oxygen is adsorbed on the surface of the In-film-holding member 205, oxygen can newly react with the In film 203 to form an In oxide film. First candidates for the material are noble metal materials such as silver, gold, platinum, and so on, and metals of copper, chromium, nickel, etc. coated with gold. Furthermore, it is also desirable to employ materials that positively reduce the In surface oxide films. Such materials are hydrogen storing metals such as titanium, nickel, iron, and so on, or hydrogen storing alloys that are preliminarily made to store hydrogen at room temperature in a hydrogen atmosphere. Such materials release hydrogen at high temperature during the seal bonding, and hydrogen reacts with oxygen in the oxide films to promote the reduction reaction of the oxide films. These noble metal materials and hydrogen storing metals generally have high wettability to the liquid In, which is a preferable property.

Although the present example employs the In-film-holding member 205 of the spherical shape, there are cases where different shapes are desirable in view of the function. For example, if the material employed has high wettability enough to be sufficiently wet with In without repelling it even in a relatively large surface area, it is reasonable that the holding member is formed in a relatively sharp sectional shape and the oxide film is positively broken by stress concentration with the sharp end face. When the holding member is of conical or pyramid shape, the tip portion thereof breaks the oxide film.

In the case where the atmospheric pressure resistance is secured without the spacer 201 in a relatively small display panel, the In-film-holding member 205 can function as a thickness defining member for the In films 203 when the thickness of the In-film-holding member 205 is set equal to the thickness of the In films 203 after the seal bonding.

However, a point to be noted herein is that the In-film-holding member 205 receives all the pressure during the seal bonding in FIG. 15 and thus the In-film-holding member 205 of the foregoing sharp sectional shape raises the possibility of breaking the support frame 86 and the face plate 82 by stress concentration. In this case, it is needless to mention that it is necessary to disperse the force, for example, by increasing the number of In-film-holding members 205.

The series of steps as described, all were carried out in a vacuum chamber, whereby it became feasible simultaneously to maintain the interior of the envelope 90 in vacuum from the beginning and to make the steps simple.

The display panel as shown in FIG. 12 was produced in this way, and drive circuits consisting of a scanning circuit, a control circuit, a modulation circuit, a dc voltage supply, etc. were connected thereto, thereby producing the flat-panel image display apparatus.

In the image display apparatus of the present example produced as described above, the predetermined voltage was applied in time division to each of the electron-emitting devices through the X-directional terminals and the Y-directional terminals and the high voltage was applied to the metal back 85 through the high voltage terminal Hv, whereby an arbitrary matrix image pattern was able to be displayed in good image quality without any pixel defect.

Example 2

The present example is also an example in which the electron source substrate was produced in the configuration wherein a number of surface conduction electron-emitting devices as shown in FIG. 2 were matrix-wired and wherein the image display apparatus as shown in FIG. 12 was produced using the electron source substrate. The configurations of the electron source substrate 21 and the face plate 82 are similar to those in Example 1.

Figure 16:
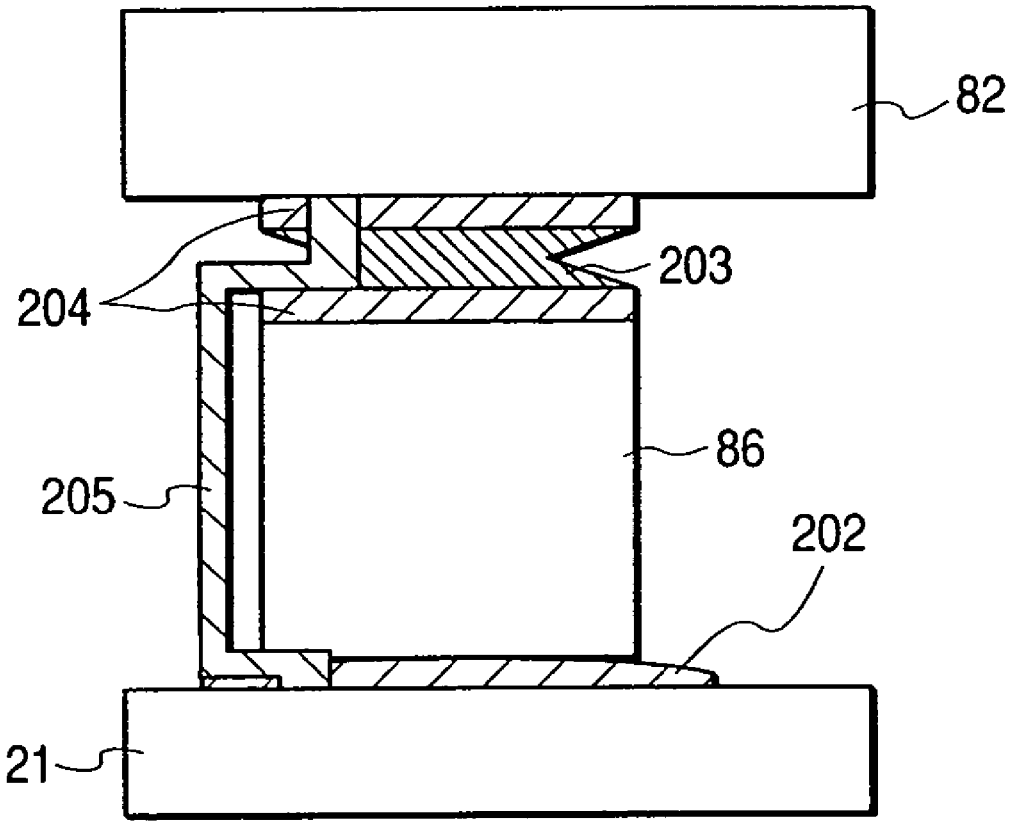
FIG. 16 is an illustration showing a schematic sectional structure of the peripheral region of the display panel (envelope) according to Example 2 of the present invention.

FIG. 16 is an illustration showing the schematic sectional structure of the peripheral region of the display panel (envelope 90) according to the present example.

In the present example, the-In-film-holding member 205 is formed in three-dimensional shape by press working. Before the support frame 86 is bonded to the rear plate (electron source substrate) 21 with frit glass 202, the In-film-holding member 205 is secured to the support frame 86 by spring pressure of the member itself. The part of the In-film-holding member 205 projecting to the end face of the support frame 86 has a function of defining the bond thickness of the frit glass 202. Furthermore, the end face on the other side has functions of holding the In films 203 and excluding the surface oxide films from the joint surfaces during the seal bonding and a function of defining the thickness of the In films 203.

Furthermore, since the In-film-holding member 205 is secured to the support frame 86 by its spring pressure, the In-film-holding member 205 has a function of positioning itself. This eliminates a possibility that the In-film-holding member 205 moves together with excess liquid In flowing out during the seal bonding, so as to fail to function as expected.

In the present example, the support frame 86 and the rear plate 21 are joined to each other with frit glass 202, but it is possible to realize a joining process at low temperature if this joining is made with In. On the other hand, in the case of both-side In joining, even if the joining is carried out either simultaneously or successively, the joint position of the support frame 86 will become easy to deviate. In the case of the both-side In joining, therefore, the In-film-holding member 205 is preferably shaped so as to be able to position the support frame 86 relative to the rear plate 21 or to the face plate 82, which eliminates a need for use of an additional positioning jig.

The seal bonding process was carried out under the vacuum environment in Example 1 and Example 2 described above, but the present invention is also effectively applicable to the case where the seal bonding is carried out under the atmospheric environment and thereafter the interior of the panel is evacuated through an exhaust substrate hole provided separately, thereby forming the envelope 90 with the vacuum gap. Namely, it is clear that the effect of breaking the oxide film with the In-film-holding member 205 becomes more prominent in that case, because the surface oxide films of the In films 203 become thicker under the atmospheric environment.

As described above, the image display apparatus of the present invention is able to display images with good quality over long periods of time while suppressing the occurrence of the vacuum leakage and maintaining high performance of the electron-emitting devices.

What is claimed is:

1. A method of producing an image display apparatus comprising an envelope having a first substrate, and a second substrate opposed with a gap to the first substrate, wherein an image display member is placed in the envelope, said method comprising the steps of disposing in a peripheral region of the first substrate or the second substrate, a joining member of a metal having inside thereof a member of a high melting point material which has a melting point higher than that of the joining member, and which is enveloped in the joining member, so that the joining member continuously surrounds the image display member on the first or second substrate, and thereafter heating the joining member for seal bonding the first and second substrates.

2. The method according to claim 1, wherein the member of the high melting point material is a metal.

3. The method according to claim 1, wherein said image display member comprises an electron-emitting device and a phosphor.

* * * * *